US007301473B2

(12) United States Patent
Shah et al.

(10) Patent No.: US 7,301,473 B2
(45) Date of Patent: Nov. 27, 2007

(54) RECEIVER FOR AN ACOUSTIC TELEMETRY SYSTEM

(75) Inventors: Vimal V. Shah, Sugar Land, TX (US); Wallace R. Gardner, Houston, TX (US); Donald G. Kyle, Plano, TX (US)

(73) Assignee: Halliburton Energy Services Inc., Houston, TX (US)

( * ) Notice: Subject to any disclaimer, the term of this patent is extended or adjusted under 35 U.S.C. 154(b) by 516 days.

(21) Appl. No.: 10/925,267

(22) Filed: Aug. 24, 2004

(65) Prior Publication Data

US 2006/0044939 A1 Mar. 2, 2006

(51) Int. Cl.
*G01V 3/00* (2006.01)

(52) U.S. Cl. ..... 340/854.4; 367/82; 375/353; 702/6

(58) Field of Classification Search ..... 340/854.4; 367/82; 375/353; 702/6
See application file for complete search history.

(56) References Cited

U.S. PATENT DOCUMENTS 4,210,967 A * 7/1980 Ingram ..... 367/34
4,642,800 A * 2/1987 Umeda ..... 367/85

* cited by examiner

*Primary Examiner*—Timothy Edwards, Jr.
(74) *Attorney, Agent, or Firm*—Schwegman, Lundberg & Woessner P.A.

(57) ABSTRACT

One embodiment includes a method comprising receiving an acoustic signal that is propagated along a drill string. The method also includes correlating the acoustic signal to a first stored acoustic signal representing a first symbol, wherein the first stored acoustic signal is acquired from a propagation along the drill string in an approximately noise free environment.

46 Claims, 11 Drawing Sheets

RECEIVER FOR AN ACOUSTIC TELEMETRY SYSTEM

TECHNICAL FIELD

The application relates generally to a telemetry system for data communications between a downhole drilling assembly and a surface of a well. In particular, the application relates to a receiver for an acoustic telemetry system.

BACKGROUND

During drilling operations for extraction of hydrocarbons, a variety of communication and transmission techniques have been attempted to provide real time data from the vicinity of the bit to the surface during drilling. The use of measurements while drilling (MWD) with real time data transmission provides substantial benefits during a drilling operation. For example, monitoring of downhole conditions allows for an immediate response to potential well control problems and improves mud programs.

Measurement of parameters such as weight on bit, torque, wear and bearing condition in real time provides for more efficient drilling operations. In fact, faster penetration rates, better trip planning, reduced equipment failures, fewer delays for directional surveys, and the elimination of a need to interrupt drilling for abnormal pressure detection is achievable using MWD techniques.

Currently, there are four major categories of telemetry systems that have been used in an attempt to provide real time data from the vicinity of the drill bit to the surface; namely, acoustic waves, mud pressure pulses, insulated conductors and electromagnetic waves.

With regard to acoustic waves, typically, an acoustic signal is generated near the bit and is transmitted through the drill pipe, mud column or the earth. It has been found, however, that the very low intensity of the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission. Such reflective and refractive interference causes interbit interference among the bits of data being transmitted.

In a mud pressure pulse system, the resistance of mud flow through a drill string is modulated by means of a valve and control mechanism mounted in a special drill collar near the bit. This type of system typically transmits at one bit per second as the pressure pulse travels up the mud column at or near the velocity of sound in the mud. It is well known that mud pulse systems are intrinsically limited to a few bits per second due to attenuation and spreading of pulses.

Insulated conductors or hard wire connection from the drill bit to the surface is an alternative method for establishing downhole communications. This type of system is capable of a high data rate and two-way communication is possible. It has been found, however, that this type of system requires a special drill pipe and special tool joint connectors that substantially increase the cost of a drilling operation. Also, these systems are prone to failure as a result of the abrasive conditions of the mud system and the wear caused by the rotation of the drill string.

The fourth technique used to telemeter downhole data to the surface uses the transmission of electromagnetic waves through the earth. A current carrying downhole data signal is input to a toroid or collar positioned adjacent to the drill bit or input directly to the drill string. When a toroid is utilized, a primary winding, carrying the data for transmission, is wrapped around the toroid and a secondary is formed by the drill pipe. A receiver is connected to the ground at the surface where the electromagnetic data is picked up and recorded. It has been found, however, that in deep or noisy well applications, conventional electromagnetic systems are unable to generate a signal with sufficient intensity to be recovered at the surface.

In general, the quality of an electromagnetic signal reaching the surface is measured in terms of signal to noise ratio. As the ratio drops, it becomes more difficult to recover or reconstruct the signal. While increasing the power of the transmitted signal is an obvious way of increasing the signal to noise ratio, this approach is limited by batteries suitable for the purpose and the desire to extend the time between battery replacements. These approaches have allowed development of commercial borehole electromagnetic telemetry systems that work at data rates of up to four bits per second and at depths of up to 4000 feet without repeaters in MWD applications. It would be desirable to transmit signals from deeper wells and with much higher data rates which will be required for logging while drilling, LWD, systems.

BRIEF DESCRIPTION OF THE DRAWINGS

Embodiments of the invention may be best understood by referring to the following description and accompanying drawings which illustrate such embodiments. The numbering scheme for the Figures included herein are such that the leading number for a given reference number in a Figure is associated with the number of the Figure. For example, a system 100 can be located in FIG. 1. However, reference numbers are the same for those elements that are the same across different Figures. In the drawings.

DETAILED DESCRIPTION

Methods, apparatus and systems for an acoustic telemetry receiver are described. In the following description, numerous specific details are set forth. However, it is understood that embodiments of the invention may be practiced without these specific details. In other instances, well-known circuits, structures and techniques have not been shown in detail in order not to obscure the understanding of this description.

While described with reference to transmitting downhole data to the surface during measurements while drilling (MWD), embodiments of the invention are not so limited. For example, some embodiments are applicable to transmission of data from the surface to equipment that is downhole. Additionally, some embodiments of the invention are applicable not only during drilling, but throughout the life of a wellbore including, but not limited to, during logging, drill stem testing, completing and production. Further, some embodiments of the invention can be in other noisy conditions, such as hydraulic fracturing and cementing.

As further described below, embodiments of the invention attempt to minimize cross correlation between/among the different symbols to allow for the identification of the symbols. Embodiments of the invention allow for a more robust data recovery of acoustic telemetry through tubulars under various noisy conditions. Additionally, embodiments of the invention allowed for an increased data rate of acoustic telemetry through tubulars while maintaining reliable data recovery. Embodiments of the invention may remove intersymbol interference. This removal of intersymbol interference allows for correlation of a symbol with a database of acquired symbols to determine a value of a symbol.

Figure 1:
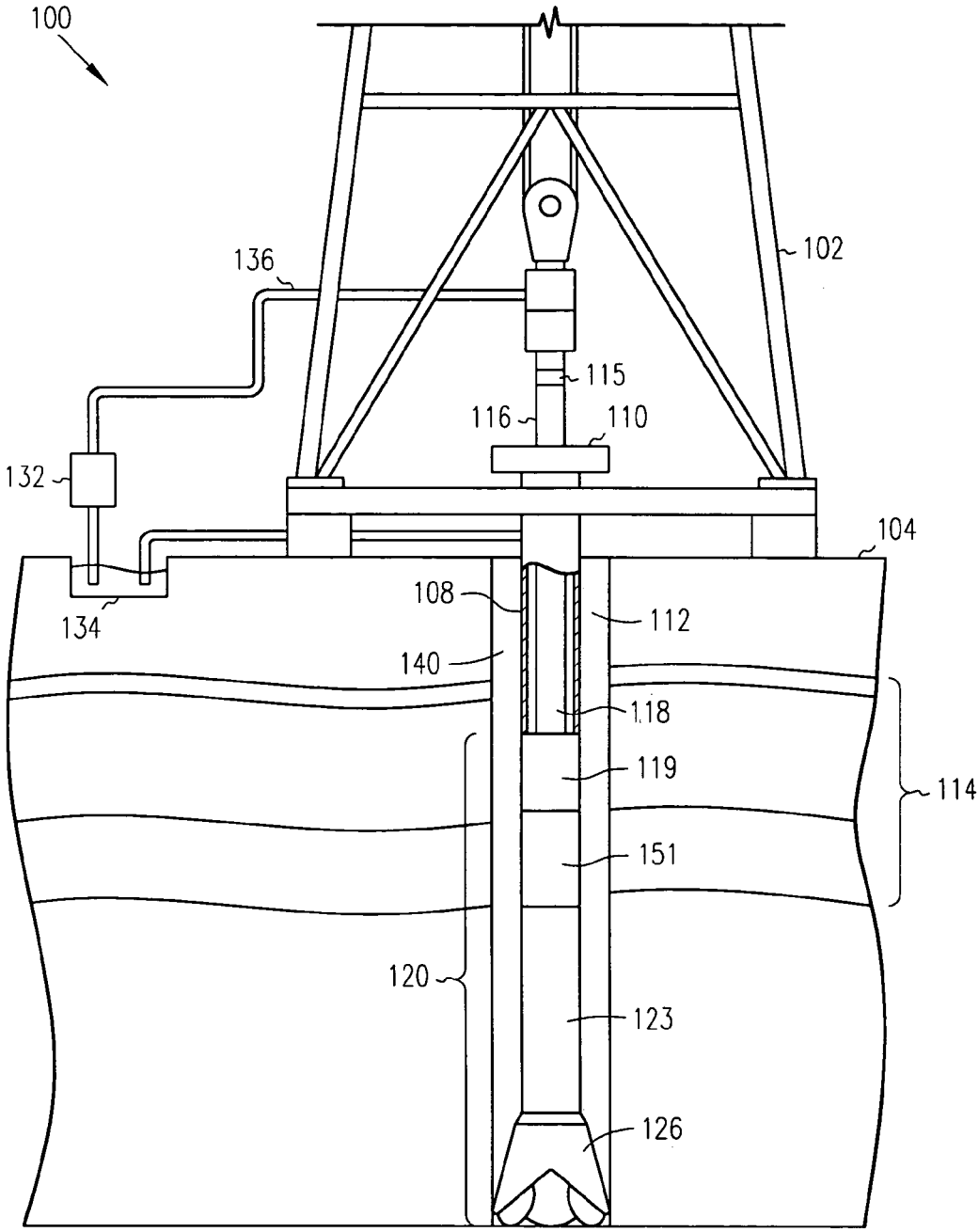
FIG. 1 illustrates a system for drilling operations, according to some embodiment of the invention.

FIG. 1 illustrates a system for drilling operations, according to some embodiments of the invention. A system 100 includes a drilling rig 102 located at a surface 104 of a well. The drilling rig 102 provides support for a drill string 108. The drill string 108 penetrates a rotary table 110 for drilling a borehole 112 through subsurface formations 114. The drill string 108 includes a Kelly 116 (in the upper portion), a drill pipe 118 and a bottom hole assembly 120 (located at the lower portion of the drill pipe 118). The bottom hole assembly 120 may include a drill collar 122, a downhole tool 124 and a drill bit 126. The downhole tool 124 may be any of a number of different types of tools including Measurement While Drilling (MWD) tools, Logging While Drilling (LWD) tools, etc.

During drilling operations, the drill string 108 (including the Kelly 116, the drill pipe 118 and the bottom hole assembly 120) may be rotated by the rotary table 110. In addition or alternative to such rotation, the bottom hole assembly 120 may also be rotated by a motor (not shown) that is downhole. The drill collar 122 may be used to add weight to the drill bit 126. The drill collar 122 also may stiffen the bottom hole assembly 120 to allow the bottom hole assembly 120 to transfer the weight to the drill bit 126. Accordingly, this weight provided by the drill collar 122 also assists the drill bit 126 in the penetration of the surface 104 and the subsurface formations 114.

During drilling operations, a mud pump 132 may pump drilling fluid (known as "drilling mud") from a mud pit 134 through a hose 136 into the drill pipe 118 down to the drill bit 126. The drilling fluid can flow out from the drill bit 126 and return back to the surface through an annular area 140 between the drill pipe 118 and the sides of the borehole 112. The drilling fluid may then be returned to the mud pit 134, where such fluid is filtered. Accordingly, the drilling fluid can cool the drill bit 126 as well as provide for lubrication of the drill bit 126 during the drilling operation. Additionally, the drilling fluid removes the cuttings of the subsurface formations 114 created by the drill bit 126.

The drill string 108 may include one to a number of different sensors 151, which monitor different downhole parameters. Such parameters may include the downhole temperature and pressure, the various characteristics of the subsurface formations (such as resistivity, density, porosity, etc.), the characteristics of the borehole (e.g., size, shape, etc.), etc. The drill string 108 may also include an acoustic telemetry transmitter 123 that transmits telemetry signals in the form of acoustic vibrations in the tubing wall of the drill sting 108. An acoustic telemetry receiver 115 is coupled to the kelly 116 to receive transmitted telemetry signals. One or more repeaters 119 may be provided along the drill string 108 to receive and retransmit the telemetry signals. The repeaters 119 may include both an acoustic telemetry receiver and an acoustic telemetry transmitter configured similarly to the acoustic telemetry receiver 115 and the acoustic telemetry transmitter 123.

Figure 2:
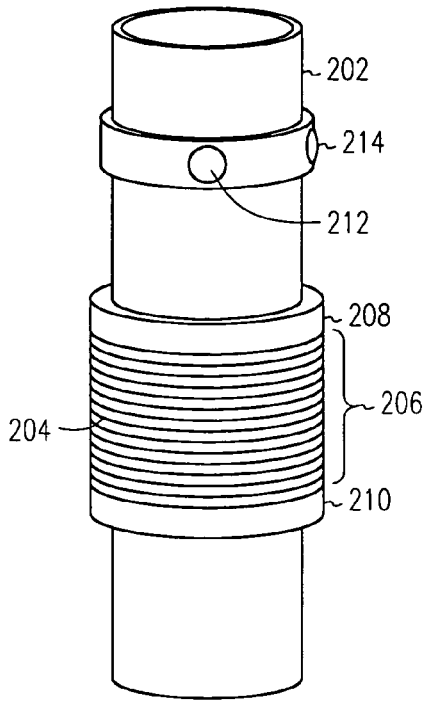
FIG. 2 illustrates a repeater along a drill string, according to some embodiments of the invention.

FIG. 2 illustrates a repeater along a drill string, according to some embodiments of the invention. In particular, FIG. 2 illustrates one embodiment of the repeaters 119. As shown, the repeaters 119 may include an acoustic telemetry transmitter 204 and an acoustic sensor 212 mounted on a piece of tubing 202. One skilled in the art will understand that acoustic sensor 212 is configured to receive signals from a distant acoustic transmitter, and that the acoustic telemetry transmitter 204 is configured to transmit to a distant acoustic sensor. Consequently, although the acoustic telemetry transmitter 204 and the acoustic sensor 212 are shown in close proximity, they would only be so proximate in a repeater 119 or in a bi-directional communications system. Thus, for example, the acoustic telemetry transmitter 123 might only include the acoustic telemetry transmitter 204, while the acoustic telemetry receiver 115 might only include sensor 212, if so desired.

The following discussion centers on acoustic signaling from acoustic telemetry transmitter 123 near the drill bit 126 to a sensor located some distance away along the drill string. Various acoustic transmitters are known in the art, as evidenced by U.S. Pat. Nos. 2,810,546, 3,588,804, 3,790,930, 3,813,656, 4,282,588, 4,283,779, 4,302,826, 4,314,365, and 6,137,747, which are hereby incorporated by reference. The transmitter 204 shown in FIG. 2 has a stack of piezoelectric washers 206 sandwiched between two metal flanges 208, 210. When the stack of piezoelectric washers 206 is driven electrically, the stack 206 expands and contracts to produce axial compression waves in tubing 202 that propagate axially along the drill string. Other transmitter configurations may be used to produce torsional waves, radial compression waves, or even transverse waves that propagate along the drill string.

Various acoustic sensors are known in the art including pressure, velocity, and acceleration sensors. The sensor 212 preferably comprises a two-axis accelerometer that senses accelerations along the axial and circumferential directions. One skilled in the art will readily recognize that other sensor configurations are also possible. For example, the sensor 212 may comprise a three-axis accelerometer that also detects acceleration in the radial direction. A second sensor 214 may be provided 90 or 180 degrees away from the first sensor 212. This second sensor 214 also preferably comprises a two or three axis accelerometer. Additional sensors may also be employed as needed.

Figure 3:
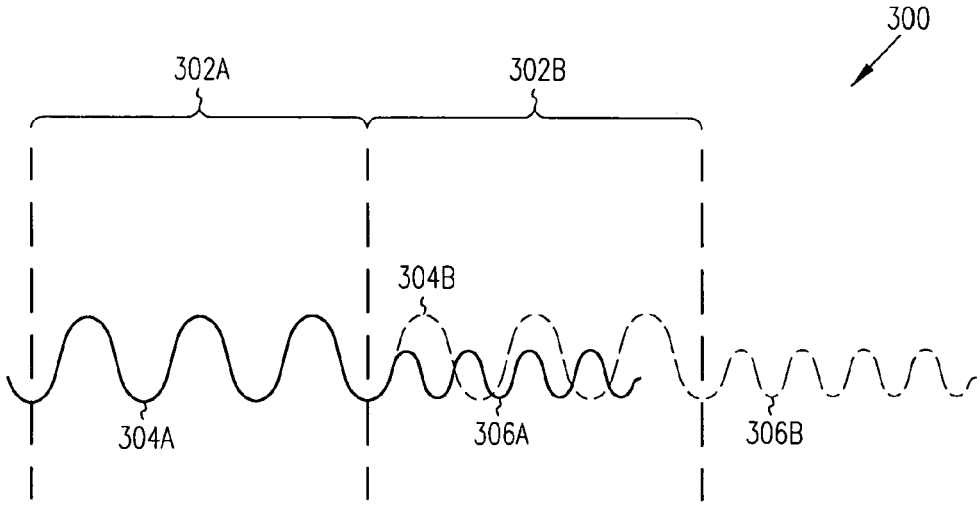
FIG. 3 is a timing diagram of an acoustic signal received across a number of symbolic intervals, according to some embodiments of the invention.

In some embodiments, the acoustic telemetry receiver receives an acoustic signal across a number of different symbolic intervals. In some embodiments, the acoustic telemetry receiver subtracts the tail of the acoustic signal of a previous symbolic interval from the acoustic signal of a current symbolic interval. To help illustrate, FIG. 3 is a timing diagram of an acoustic signal received across a number of symbolic intervals, according to some embodiments of the invention. FIG. 3 illustrates a timing diagram 300 for a first symbol 304A that is represented by a solid line and a second symbol 304B that is represented by a dashed line. The first symbol 304A is received by the acoustic telemetry receiver in a symbolic interval 302A. The second symbol 304B is received by the acoustic telemetry receiver in a symbolic interval 302B. As shown, a tail 306A of the symbol 304A carries over into the symbolic interval 302B, thereby causing intersymbol interference with the symbol 304B. A tail 306B of the symbol 304B carries over into a subsequent symbolic interval. Some embodiments of the invention may subtract the tail from the symbol for a previous symbolic interval from the symbol for the current symbolic interval to reduce the intersymbol interference.

Figure 4:
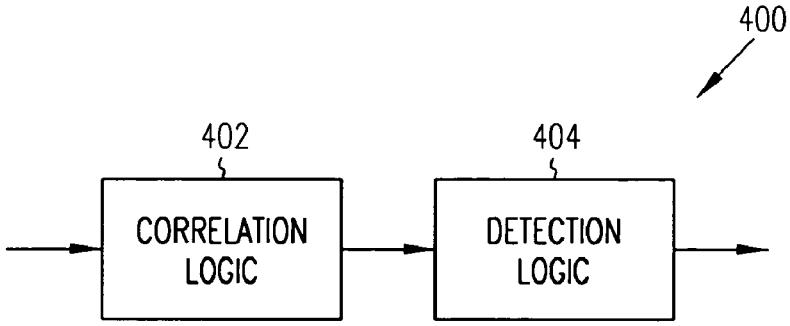
FIG. 4 illustrates a receiver for an acoustic telemetry system, according to some embodiments of the invention.
Figure 5:
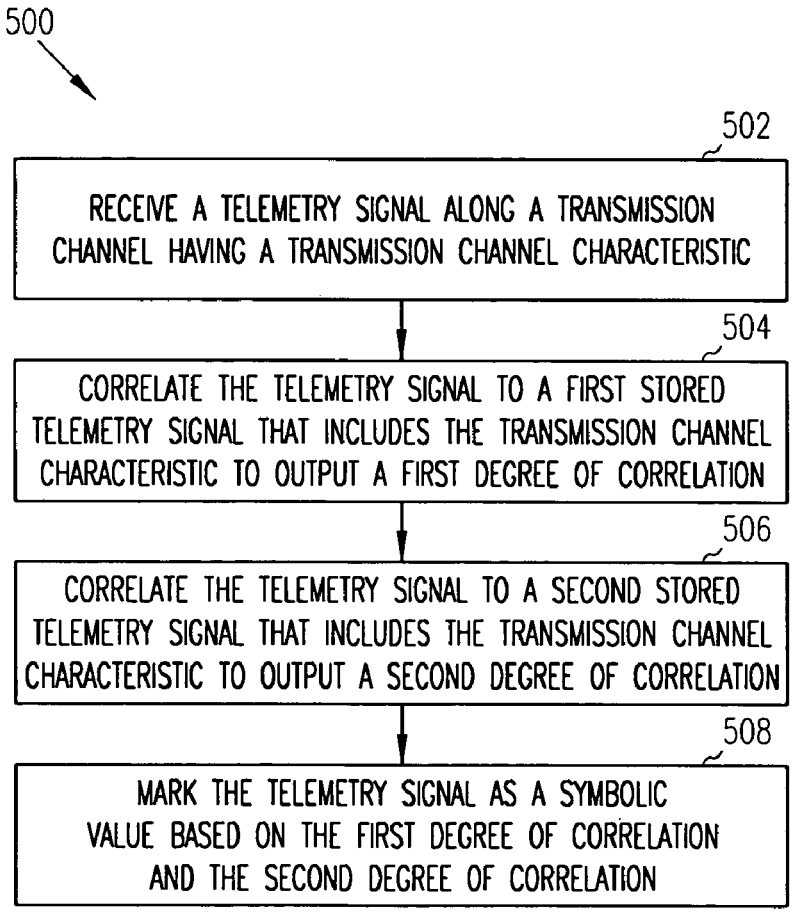
FIG. 5 illustrates a flow diagram for operations of a receiver for an acoustic telemetry system, according to some embodiments of the invention.
Figure 6:
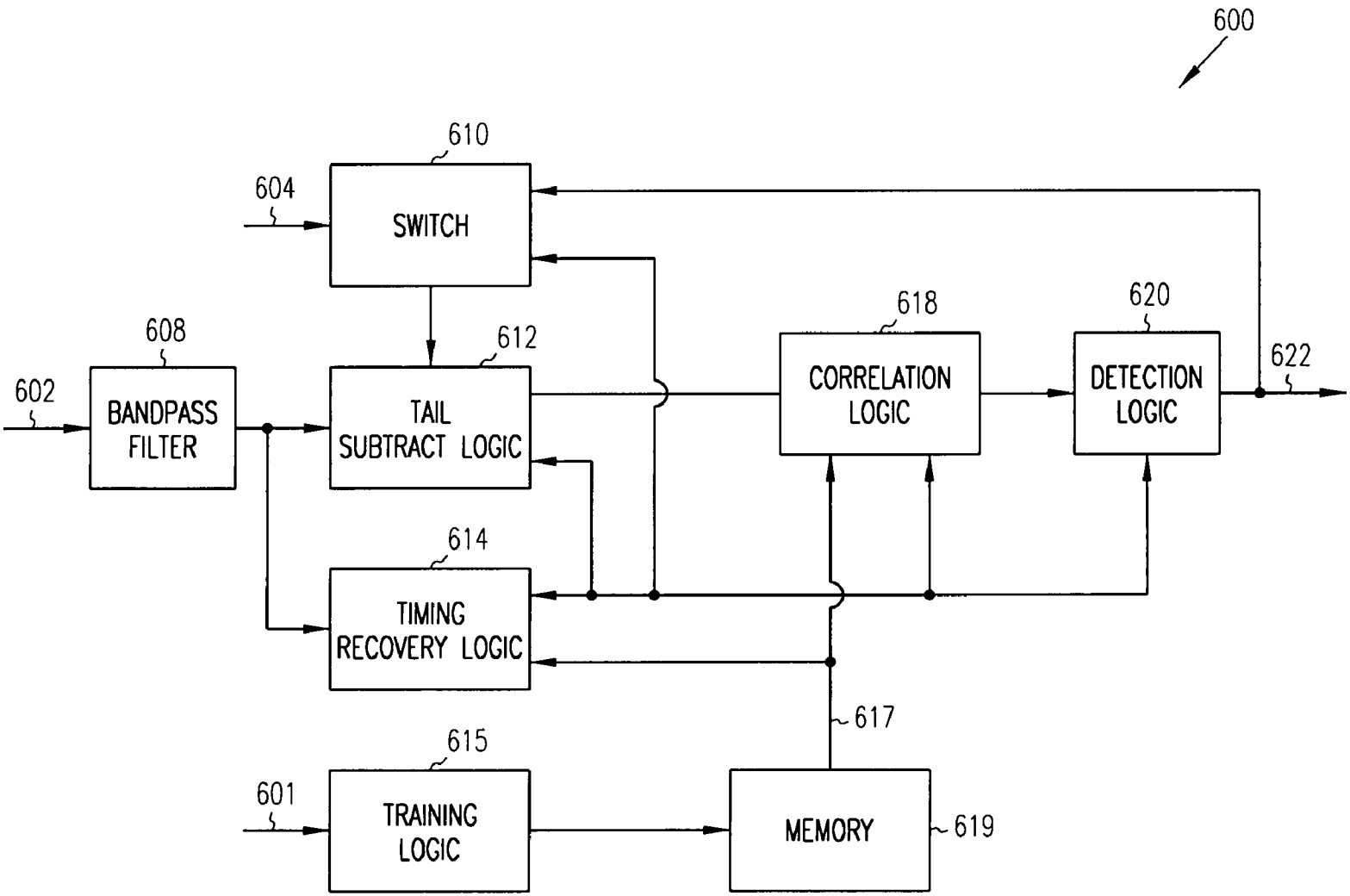
FIG. 6 illustrates an on-off key-based receiver for an acoustic telemetry system, according to some embodiments of the invention.
Figure 7:
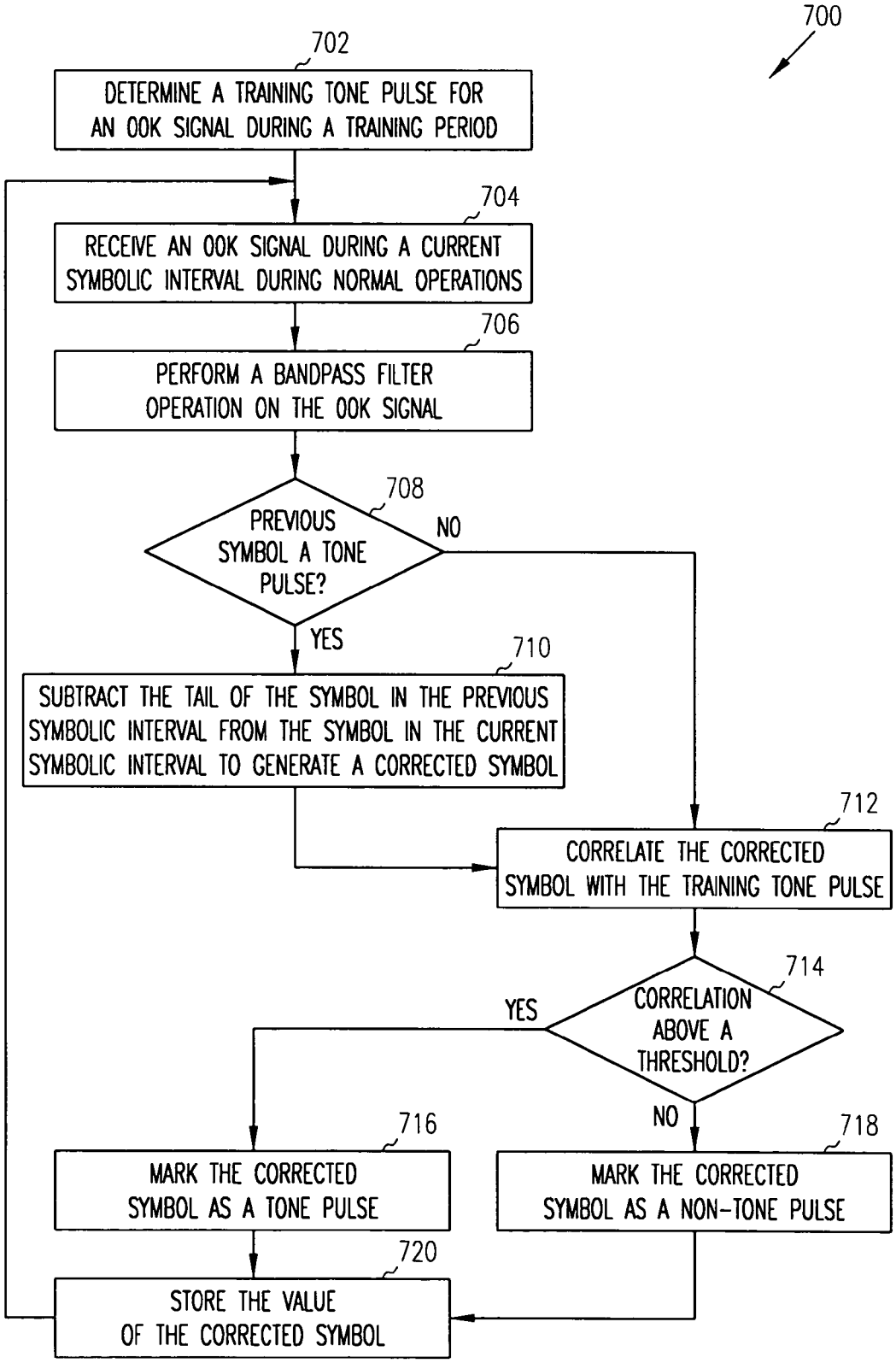
FIG. 7 illustrates a flow diagram for operations of an OOK receiver, according to some embodiments of the invention.
Figure 8:
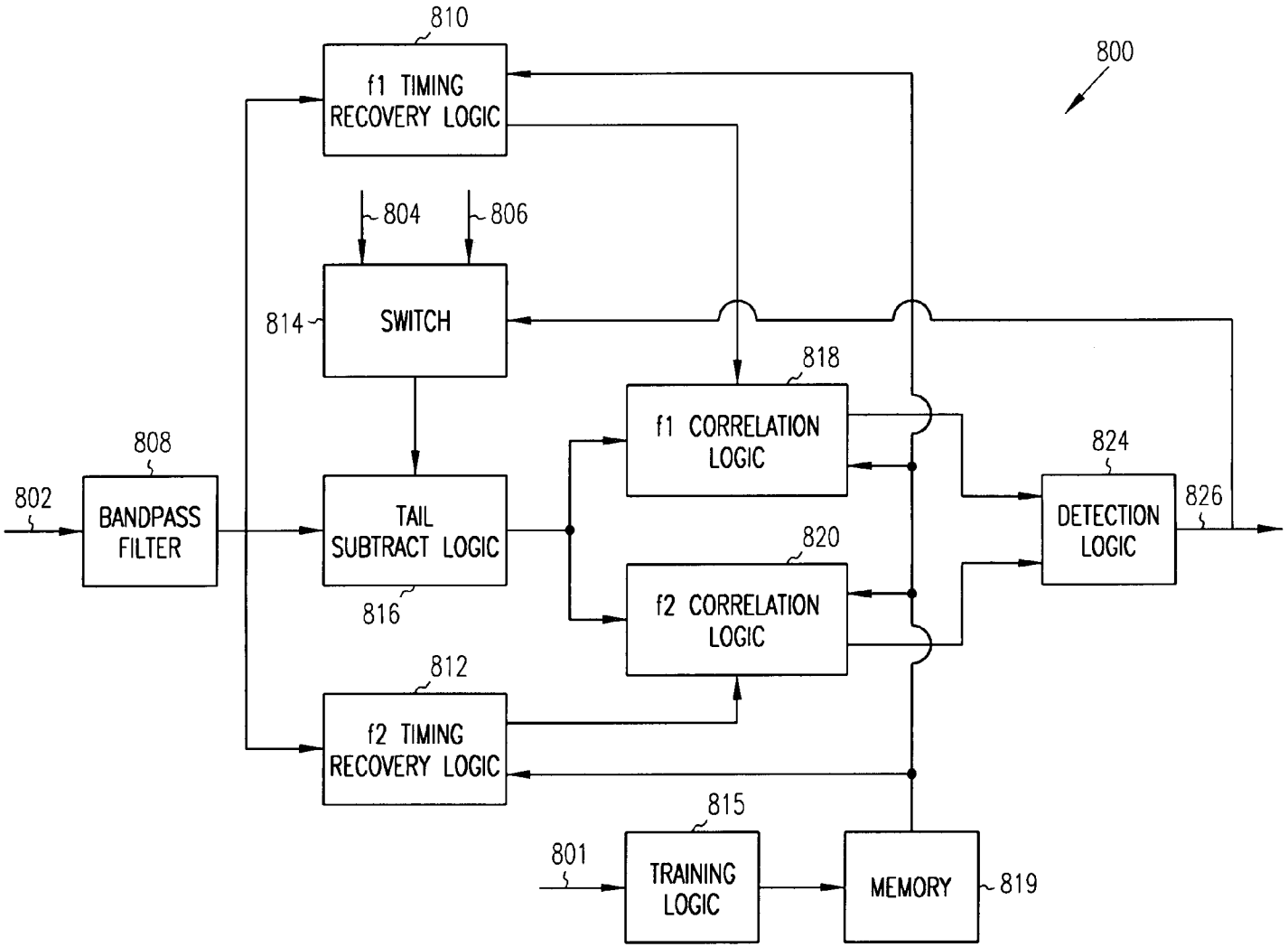
FIG. 8 illustrates a frequency shift key-based receiver for an acoustic telemetry system, according to some embodiments of the invention.

Different embodiments of an acoustic telemetry receiver are now described. Such embodiments may be different embodiments of the acoustic telemetry receiver 115. In particular, FIGS. 4 and 5 illustrate an embodiment of the acoustic telemetry receiver 115 and an embodiment of the operations thereof, respectively. FIGS. 6 and 7 illustrate an on-off key-based embodiment of the acoustic telemetry receiver 115 and an embodiment of the operations thereof, respectively. FIGS. 8 and 9 illustrate frequency shift key-based embodiment of the acoustic telemetry receiver 115 and an embodiment of the operations thereof, respectively. FIGS. 10 and 11 illustrate a phase shift key-based embodiment of the acoustic telemetry receiver 115 and an embodiment of the operations thereof, respectively.

FIG. 4 illustrates a receiver for an acoustic telemetry system, according to some embodiments of the invention. In particular, FIG. 4 illustrates a receiver 400 that includes a correlation logic 402 and a detection logic 404. The correlation logic 402 is coupled to receive a telemetry signal. For example, the telemetry signal may be an acoustic signal that is propagated along a drill string. The correlation logic 402 may perform one to a number of correlations to stored telemetry signals to determine degrees of correlation. The output of the correlation logic 402 is coupled to the input of the detection logic 404. The detection logic 404 may determine the symbol within the telemetry signal based on the degrees of correlation. The output of the detection logic 404 may be the symbolic values. Such symbolic values may represent communications (such as communications from downhole).

One embodiment of the operations of the receiver 400 is now described in more detail in conjunction with a flow diagram 500 of FIG. 5. In particular, FIG. 5 illustrates a flow diagram for operations of a receiver for an acoustic telemetry system, according to some embodiments of the invention.

In block 502, a telemetry signal that is transmitted along a transmission channel (having a transmission channel characteristic) is received. With reference to the embodiment of FIG. 4, the correlation logic 402 receive the telemetry signal. In some embodiments, the correlation logic 402 may receive this signal during drilling operations. The telemetry signal may be an acoustic signal (that is transmitted from an acoustic telemetry transmitter downhole) along the drill string 108. The transmission channel chacteristic may include the different physical characteristics of the drill sting (including, length, thickness, shape, number of sections of drill pipe that is part of the drill string, etc.). Control continues at block 504.

In block 504, the telemetry signal is correlated to a first stored telemetry signal that includes the transmission channel characteristic to output a first degree of correlation. With reference to the embodiment of FIG. 4, the correlation logic 402 performs this correlation. The correlation logic 402 may compare the signals and output a degree of correlation that may be a value indicative of such comparison. In some embodiments, logic (not shown in FIG. 4) may also remove intersymbol interference from the received telemetry signal prior to this correlation. Such operations are described in more detail below. The first stored telemetry signal may be one of a number of stored telemetry signal (such as from a library of signals) that is stored. This library of signals may be generated during an approximately noise free environment (such as when drilling operations are not being performed).

For example, the acoustic telemetry transmitter may generate a sequence of different symbols that are received by the receiver 400 during a period when no drilling operations are performed. The received symbols include the different characteristics of the drill string. In particular, the received symbols include the distortions made thereto as a result of the characteristics of the drill string. Control continues at block 506.

In block 506, the telemetry signal is correlated to a second stored telemetry signal that includes the transmission channel characteristic to output a second degree of correlation. With reference to the embodiment of FIG. 4, the correlation logic 402 performs this correlation. Control continues at block 508.

In block 508, the telemetry signal is marked as a particular symbolic value based on the first degree of correlation and the second degree of correlation. With reference to the embodiment of FIG. 4, the detection logic 404 marks the telemetry signal. The detection logic 404 may mark this telemetry signal based on either or both of the degrees of correlation. For example, if the telemetry signal received may be one of two symbols, the detection logic 404 may mark the telemetry signal as a first symbol if the first degree of correlation is above a maximum threshold and if the second degree of correlation is below a minimum threshold. In other words, the telemetry signal may be marked as a given symbol base on the correlation with one stored telemetry signal and the lack of correlation with a second stored telemetry signal. A more detailed description of such correlation comparisons is provided below.

While the flow diagram 500 illustrates the correlation with two stored telemetry signals, embodiments of the invention may correlate with a lesser or greater number of such signals. For example, the received telemetry signal may be correlated with any of a number of the signals stored in a library of signals.

FIG. 6 illustrates an on-off key-based receiver for an acoustic telemetry system, according to some embodiments of the invention. In particular, FIG. 6 illustrates an on-off key (OOK) receiver 600 that includes a bandpass filter 608, a switch 610, a tail subtract logic 612, a timing recovery logic 614, a training logic 615, a correlation logic 618, a memory 619 and a detection logic 620.

The bandpass filter 608 receives an on-off key (OOK) signal 602. The switch 610 receives a tail signal 604. The tail signal 604 is a tail from a previous timing interval for a tone pulse. The training logic 615 receives a training OOK signal 601. The training logic 615 is coupled to the memory 619. The memory 619 is coupled to a first input of the correlation logic 618 and a first input of the timing recovery logic 614. An output from the bandpass filter 608 is coupled to a first input of the tail subtract logic 612 and a second input of the timing recovery logic 614.

The timing recovery logic 614 may determine the time of the symbolic interval. In some embodiments, the output of the timing recovery logic 614 peaks after the received input most closely matches the shape of the training pulse 617. While the timing recovery logic 614 may be any of a number of different timing circuits, in some embodiments, the timing recovery logic 614 is an early-late-gate correlation timing circuit.

An output of the switch is coupled to a second input of the tail subtract logic 612. An output of the tail recovery logic is coupled to a third input of the tail subtract logic 612, a second input of the correlation logic 618 and a detection logic 620. An output of the tail subtract logic 612 is coupled to a third input of the correlation logic 618.

An output of the correlation logic 618 is coupled to a second input of the detection logic 620. The output of the detection logic 620 is an output signal 622 of the OOK receiver 600. The output signal 622 is coupled an input of the switch 610.

One embodiment of the operations of the OOK receiver 600 is now described in more detail in conjunction with a flow diagram 700 of FIG. 7. In particular, FIG. 7 illustrates a flow diagram for operations of an OOK receiver, according to some embodiments of the invention.

In block 702, a training tone pulse for an OOK signal during a training period is determined. With reference to the embodiment of FIG. 6, the training logic 615 may make this determination. For binary signaling, the OOK signal 602 may be a tone pulse over a symbolic interval for data "one" and a gap over a symbolic interval for data "zero". Accordingly, the training OOK signal 601 may be a sequence of approximately identical widely spaced tone pulses sent by the acoustic telemetry transmitter 123. In particular, the sequence of tone pulses is widely spaced such that there is no interference between the pulses. The training logic 615 may receive the training OOK signal 601 during an approximately noise free operating environment. For example, the drill string 108 is not in motion to turn/move the drill bit (as is typical during normal drilling operations). The training logic 615 may store these trained tone pulses into the memory 619. As further described below, the correlation logic 618 may correlate these trained tone pulses with the acoustic signals received during normal drilling operations. Additionally, the timing recovery logic 614 may determine the time of the symbolic interval during this training period. Control continues at block 704.

In block 704, an OOK signal is received during a current symbolic interval during normal operations. With reference to the embodiment of FIG. 6, the bandpass filter 608 may receive the OOK signal 602. Normal operations may include drilling operations or operations related thereto (e.g., trip operations, etc.). The location of the current symbolic interval may be based on the timing of such interval (received from the timing recovery logic 614). Control continues at block 706.

In block 706, a bandpass filter operation is performed on the OOK signal in the current symbolic interval. With reference to the embodiment of FIG. 6, the bandpass filter 608 may perform this bandpass filter operation. The OOK signal 602 is bandpass filtered to remove any out-of-band noise. Such out-of-band noise may be introduced into the OOK signal 602 by the multiple joints along the drill string 108, drilling operations (such as the noise from the drill bit), etc. Control continues at block 708.

In block 708, a determination is made of whether the previous symbol is a tone pulse. With reference to the embodiment of FIG. 6, the switch 610 makes this determination. As shown, the output from the detection logic 620 is inputted into the switch 610. This output is an indication of whether the symbol is a tone pulse (representing a first value, such as a binary one) or a non-tone pulse (representing a second value, such as a binary zero). Accordingly, the switch 610 may make this determination based on the output from the previous symbolic interval. Upon determining that the previous symbol is a non-tone pulse, there is no need to subtract a tail of this symbol from the current symbol because there is no intersymbol interference. Therefore, control continues at block 712, which is described in more detail below. In one such embodiment, the switch 610 does not input the tail signal 604 (which is representative of a tail of a tone pulse) into the tail subtract logic 612. Upon determining that the previous symbol is a tone pulse, the switch 610 may input the tail signal 604 into the tail subtract logic 604. Additionally, upon determining that the previous symbol is a tone pulse, control continues at block 710.

In block 710, the tail of symbol in a previous symbolic interval is subtracted from the symbol in the current symbolic interval to generate a corrected symbol for the current symbolic interval. With reference to the embodiment of FIG. 6, the tail subtract logic 612 may perform this operation. The tail subtract logic 612 may subtract the tail signal 604 from the symbol in the current symbolic interval. Returning to FIG. 3, for the symbolic interval 302B, the tail 306A of the first symbol 304A (which has carried over into the symbolic interval 302B) is subtracted therefrom. Accordingly, the symbol 304B remains in the symbolic interval 302B. Control continues at block 712.

In block 712, the corrected symbol is correlated with the training tone pulse. With reference to the embodiment of FIG. 6, the correlation logic 618 correlates the corrected signal with the training tone pulse. The correlation logic 618 may perform this correlation by multiplying the corrected signal by the training tone pulse to generate a multiplied output. Control continues at block 714.

In block 714, a determination is made of whether the correlation is above a threshold. With reference to the embodiment of FIG. 6, the detection logic 620 may make this determination. The detection logic 620 may make this determination by determining if the multiplied output is greater than the threshold. In some embodiments this threshold is a configurable value that may be set based on the environment of operation. For example, a drilling operation may have a lower threshold value in comparison a drill stem test operation.

In block 716, upon determining that the correlation is above a threshold, the corrected symbol is marked as a tone pulse. With reference to the embodiment of FIG. 6, the detection logic 620 marks the corrected symbol as a tone pulse. Therefore, if the tone pulse is defined as a binary one, the corrected symbol is marked as a binary one. Control continues at block 720, which is described in more detail below.

In block 718, upon determining that the correlation is not above a threshold, the corrected symbol is marked as a non-tone pulse. With reference to the embodiment of FIG. 6, the detection logic 620 marks the corrected symbol as a non-tone pulse. Therefore, if the non-tone pulse is defined as a binary zero, the corrected symbol is marked as a binary zero. Accordingly, data communications from downhole may be interpreted in light of a sequence of symbols received. Control continues at block 720.

In block 720, the value of the corrected symbol is stored. With reference to the embodiment of FIG. 6, the detection logic 620 may store this value into a memory (not shown) internal or external to the OOK receiver 600. Such value may then be further processed to interpret the communications based on such symbols. Additionally, the detection logic 620 may store this value into a memory within the switch 610. Accordingly, for the subsequent symbolic interval, the switch 610 may or may not input the tail signal 604 into the tail subtract logic 612 depending on whether this symbol was a tone pulse or a non-tone pulse, respectively (as described in block 708). Control continues at block 704, where another OOK signal is received for the subsequent symbolic interval.

FIG. 8 illustrates a frequency shift key-based receiver for an acoustic telemetry system, according to some embodiments of the invention. In particular, FIG. 8 illustrates a frequency shift key (FSK) receiver 800 that includes a bandpass filter 802, a $f_1$ timing recovery logic 810, a $f_2$ timing recovery logic 812, a switch 814, a training logic 815, a tail subtract logic 816, a $f_1$ correlation logic 818, a memory 819, a $f_2$ correlation logic 820 and a detection logic 824.

The training logic 815 receives a training OOK signal 801. The training logic 815 is coupled to the memory 819. The memory 819 is coupled to a first input of the $f_1$ timing recovery logic 810, a first input of the $f_2$ timing recovery logic 812, a first input of the $f_1$ correlation logic 818 and a first input of the $f_2$ correlation logic 820.

The bandpass filter 808 receives a FSK signal 802. The switch 814 receives a $T(f_1)$ signal 804 and a $T(f_2)$ signal 806. The $T(f_1)$ signal 804 and the $T(f_2)$ signal 806 are tails from a previous timing interval for a first data representation and a second data representation, respectively. An output of the bandpass filter 808 is coupled to a first input of the tail subtract logic 816, a second input of the $f_1$ timing recovery logic 810 and a second input of the $f_2$ timing recovery logic 812. An output of the switch i814 is coupled to a second input of the tail subtract logic 816. An output of the $f_1$ timing recovery logic 810 is coupled to a second input of the $f_1$ correlation logic 818. An output of the $f_2$ timing recovery logic 812 is coupled to a second input of the $f_2$ correlation logic 820. The output of the tail subtract logic 816 is coupled to a second input of the $f_1$ correlation logic 818 and to a second input of the $f_2$ correlation logic 820. An output of the $f_1$ correlation logic 818 and an output of the $f_2$ correlation logic 820 are coupled as inputs into the detection logic 824. The output of the detection logic 824 is an output signal 826 of the FSK receiver 800. The output signal 826 is coupled to a third input of the switch 814.

Figure 9A:
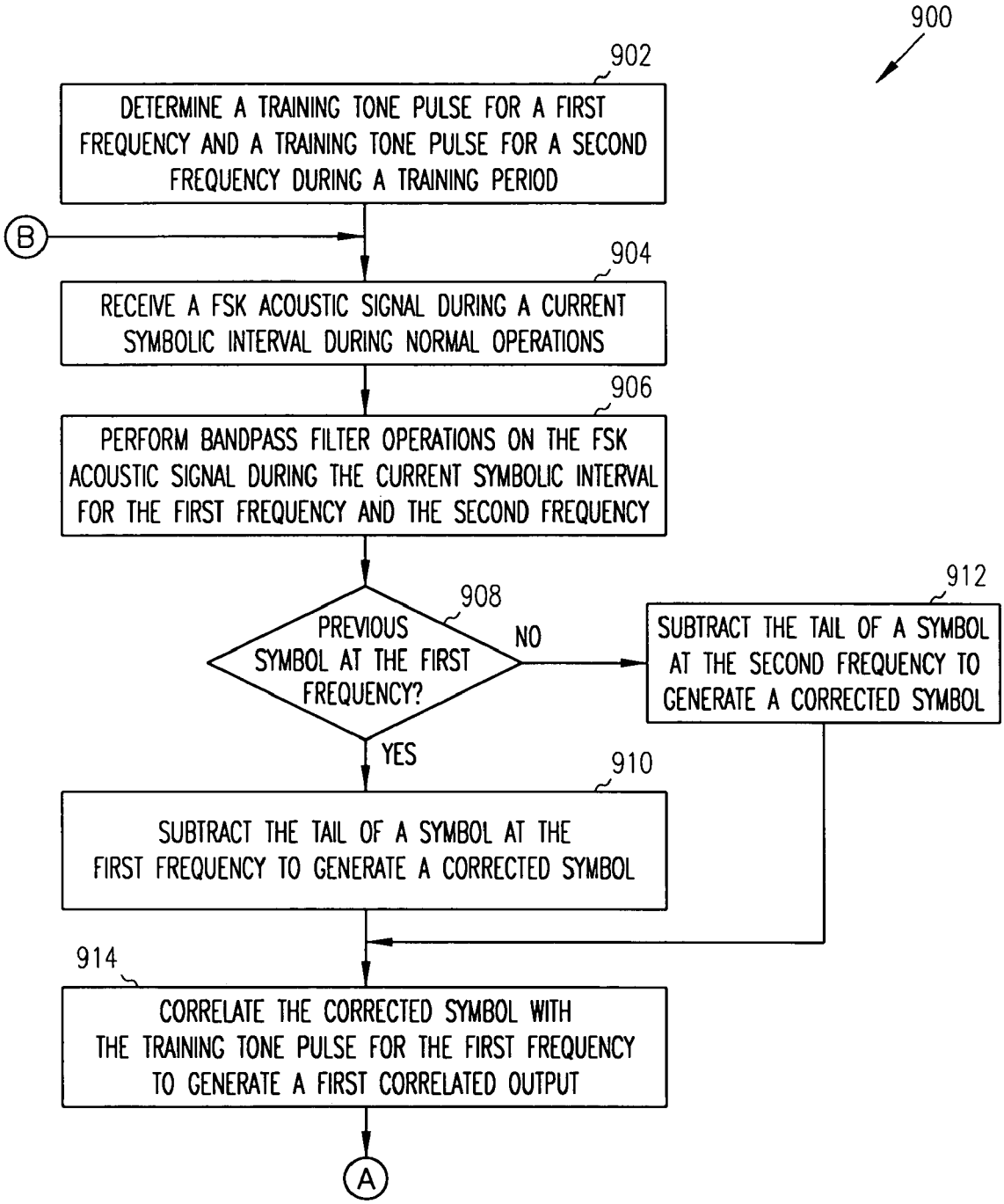
FIGS. 9A-9B illustrate a flow diagram for operations of an FSK receiver, according to some embodiments of the invention.
Figure 9B:
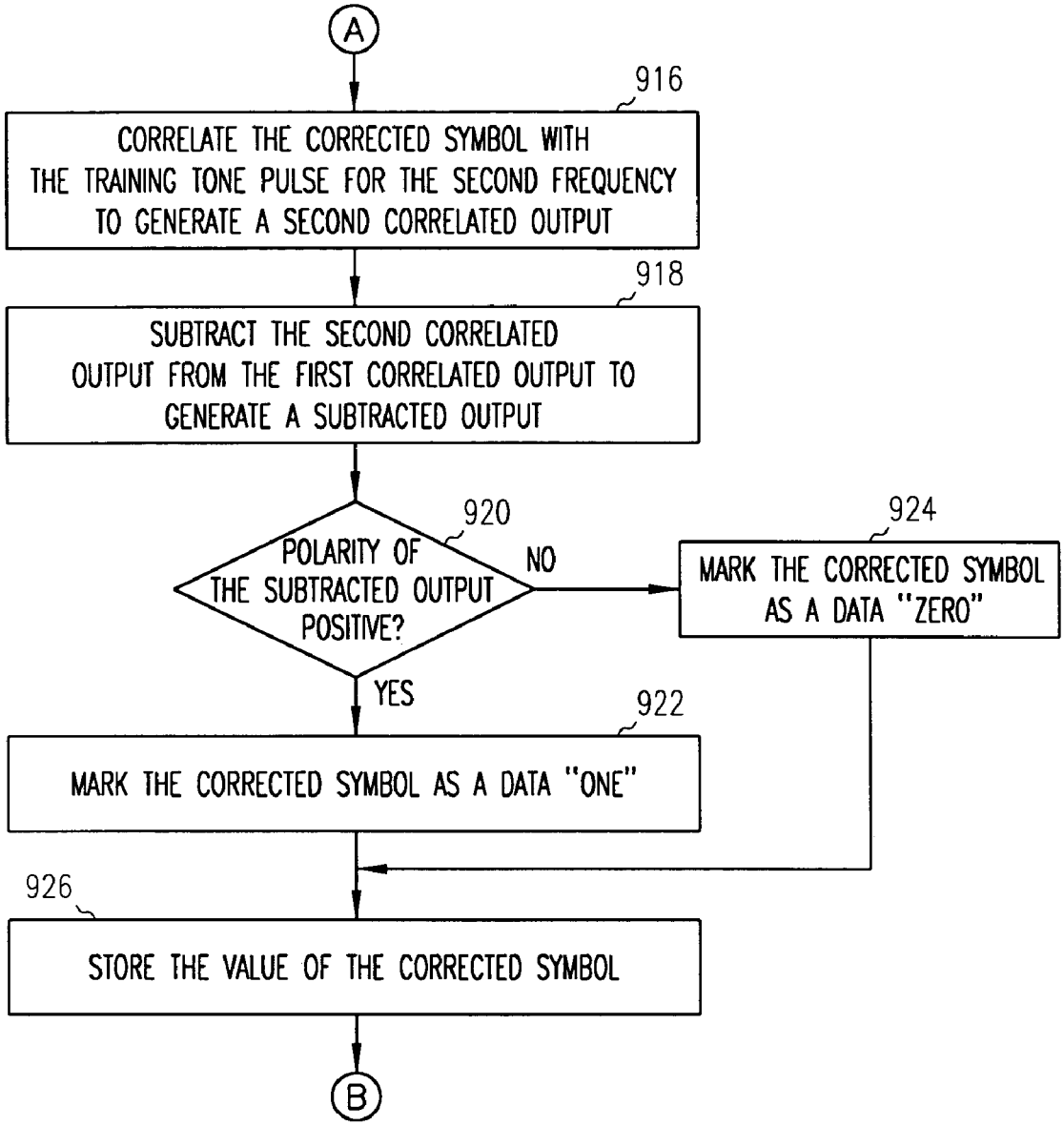
Figure 10:
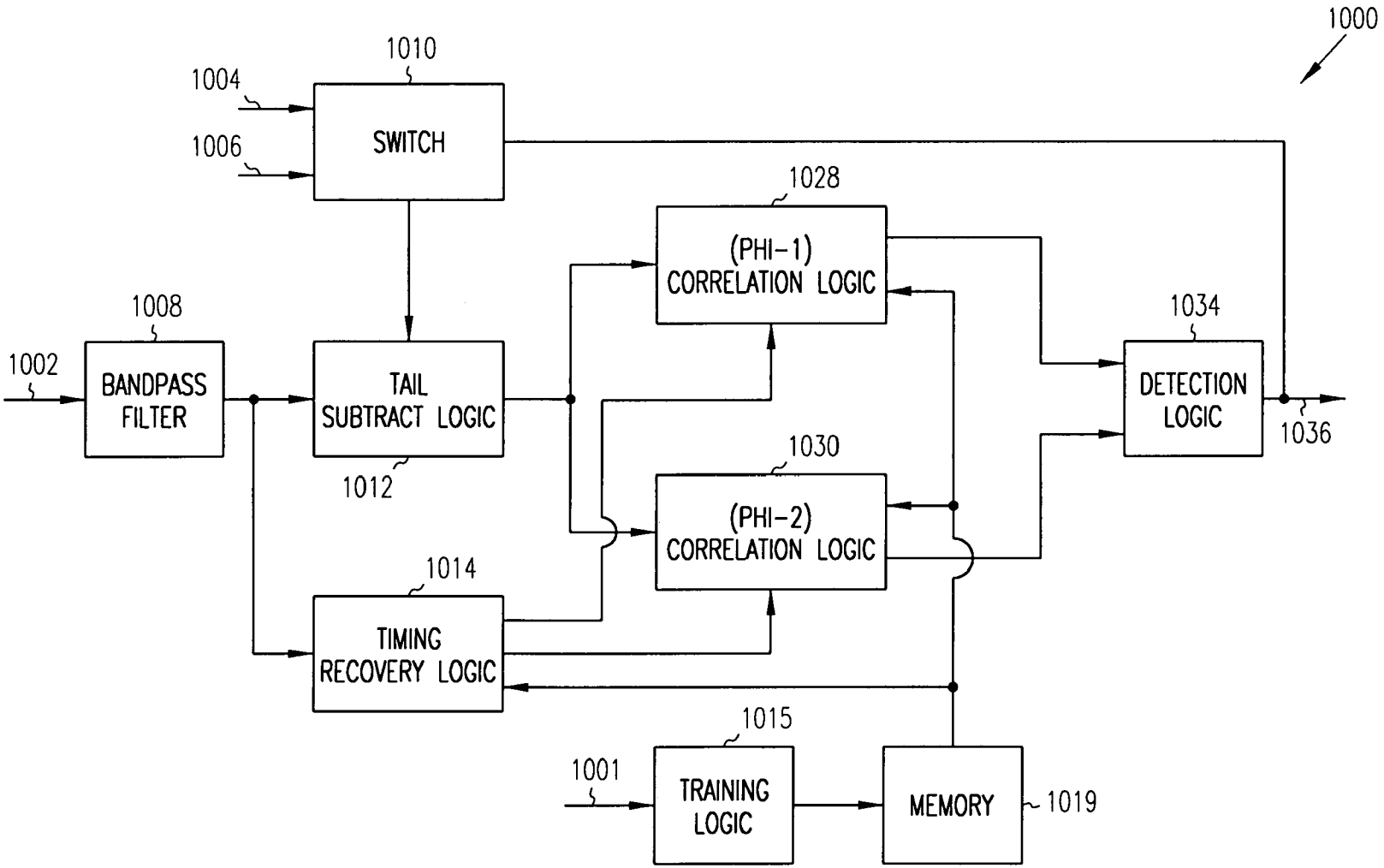
FIG. 10 illustrates a phase shift key-based receiver for an acoustic telemetry system, according to some embodiments of the invention.

One embodiment of the operations of the FSK receiver 800 is now described in more detail in conjunction with a flow diagram 900 of FIGS. 9A-9B. In particular, FIGS. 9A-9B illustrate a flow diagram for operations of an FSK receiver, according to some embodiments of the invention.

In block 902, a training tone pulse at a first frequency and a training tone pulse at a second frequency for a FSK signal during a training period are determined. With reference to the embodiment of FIG. 8, the training logic 815 may make this determination. For binary signaling, the FSK signal 802 may be a tone pulse over a symbolic interval at a first frequency for data "one" and a tone pulse over a symbolic interval at a second (different) frequency for data "zero". Accordingly, the training FSK signal 801 may be a sequence of approximately identical widely spaced tone pulses at a first frequency and a sequence of approximately identical widely spaced tone pulses at a second frequency sent by the acoustic telemetry transmitter 123. In particular, the sequence of tone pulses at the first and second frequencies is widely spaced such that there is no interference between the pulses. The training logic 815 may receive the training the FSK signal 801 during an approximately noise free operating environment. For example, the drill string 108 is not in motion to turn/move the drill bit (as is typical during normal drilling operations). The training logic 815 may store these trained tone pulses into the memory 819. As further described below, the $f_1$ correlation logic 818, and the $f_2$ correlation logic 820 may correlate these trained tone pulses with the acoustic signals received during normal drilling operations. Additionally, the $f_1$ timing recovery logic 810 and the $f_2$ timing recovery logic 812 may determine the current symbolic interval for the first frequency and the second frequency during this training period. Control continues at block 904.

In block 904, a FSK signal is received during a current symbolic interval during normal operations. With reference to the embodiment of FIG. 8, the bandpass filter 808 may receive the FSK signal 802. Normal operations may include drilling operations or operations related thereto (e.g., trip operations, etc.). The location of the current symbolic interval may be based on the timing of such interval (received from the $f_1$ timing recovery logic 810 and the $f_2$ timing recovery logic 812). Control continues at block 906.

In block 906, bandpass filter operations are performed on the FSK signal in the current symbolic interval with regard to the first frequency and the second frequency. With reference to the embodiment of FIG. 8, the bandpass filter 808 may perform this bandpass filter operation. The FSK signal 802 at the first frequency may have a different bandpass region in comparison to the FSK 802 signal at the second frequency. Accordingly, the bandpass filter 808 may perform the bandpass operation at the first frequency separate from the bandpass operation at the second frequency for the FSK signal 802. Control continues at block 908.

In block 908, a determination is made of whether the previous symbol is at the first frequency. With reference to the embodiment of FIG. 8, the switch 814 may make this determination. As shown, the output signal 826 from the detection logic 824 is inputted into the switch 814. The output signal 826 is an indication of whether the symbol is a tone pulse at the first frequency or a tone pulse at the second frequency (representing a first value, such as a binary one, or a second value, such as a binary zero, respectively). Accordingly, the switch 814 may make this determination based on the output from the previous symbolic interval.

In block 910, upon determining that the previous symbol is at the first frequency, the tail of a symbol at the first frequency is subtracted from the symbol in the current symbolic interval to generate a corrected symbol for the current symbolic interval. With reference to the embodiment of FIG. 8, the tail subtract logic 816 may perform this operation. The switch 814 may input the $T(f_1)$ signal 804 (which is a tail at the first frequency) into the tail subtract logic 816 if the previous symbol is at the first frequency. The tail subtract logic 816 may subtract the $T(f_1)$ signal 804 from the symbol in the current symbolic interval. Control continues at block 914, which is described in more detail below.

In block 912, upon determining that the previous symbol is not at the first frequency (rather the second frequency), the tail of a symbol at the second frequency is subtracted from the symbol in the current symbolic interval to generate a corrected symbol for the current symbolic interval. With reference to the embodiment of FIG. 8, the tail subtract logic 816 may perform this operation. The switch 814 may input the $T(f_2)$ signal 806 (which is a tail at the second frequency) into the tail subtract logic 816 if the previous symbol is at the second frequency. The tail subtract logic 816 may subtract the $T(f_2)$ signal 806 from the symbol in the current symbolic interval. Control continues at block 914.

In block 914, the corrected symbol is correlated with the training tone pulse at the first frequency to generate a first correlated output. With reference to the embodiment of FIG. 8, the $f_1$ correlation logic 818 may correlate the corrected signal with the training tone pulse at the first frequency. The $f_1$ correlation logic 818 compares the corrected signal with the training tone pulse at the first frequency to determine the correlation there between. Control continues at block 916.

In block 916, the corrected symbol is correlated with the training tone pulse at the second frequency to generate a second correlated output. With reference to the embodiment of FIG. 6, the $f_2$ correlation logic 620 may correlate the corrected signal with the training tone pulse at the second frequency. The $f_2$ correlation logic 620 compares the corrected signal with the training tone pulse at the second frequency to determine the correlation there between. Control continues at block 918.

In block 918, the second correlated output is subtracted from the first correlated output to generate a subtracted output. With reference to the embodiment of FIG. 6, the detection logic 624 may perform this subtraction. Control continues at block 920.

In block 920, a determination is made of whether the polarity of the subtracted output is positive. With reference to the embodiment of FIG. 6, the detection logic 624 may make this determination.

In block 922, upon determining that the polarity of the subtracted output is positive, the corrected symbol is marked as a "data one." With reference to the embodiment of FIG. 6, the detection logic 624 may mark the corrected symbol. Control continues at block 926, which is described in more detail below.

In block 924, upon determining that the polarity of the subtracted output is not positive, the corrected symbol is marked as a "data zero." With reference to the embodiment of FIG. 6, the detection logic 624 may mark the corrected symbol. Control continues at block 926.

In block 926, the value of the corrected symbol is stored. With reference to the embodiment of FIG. 6, the detection logic 624 may store this value into a memory (not shown) internal or external to the FSK receiver 600. Such value may then be further processed to interpret the communications based on such symbols. Additionally, the detection logic 624 may store this value into a memory within the switch 614. Accordingly, for the subsequent symbolic interval, the switch 614 may input the $T(f_1)$ signal 604 or the $T(f_2)$ signal 606 depending on whether this symbol was at a first frequency or a second frequency, respectively (as described in blocks 910 and 912). Control continues at block 904, where another FSK signal is received for the subsequent symbolic interval.

FIG. 10 illustrates a phase shift key-based receiver for an acoustic telemetry system, according to some embodiments of the invention. In particular, FIG. 10 illustrates a phase shift key (PSK) receiver 1000 that includes a bandpass filter 10010, a switch 1010, a tail subtract logic 1012, a timing recovery logic 1014, a training logic 1015, a memory 1019, a $(_{phi\text{-}1})$ correlation logic 1028, a $(_{phi\text{-}2})$ correlation logic 1030 and a detection logic 1034.

The training logic 1015 receives a training PSK signal 1001. The training logic 1015 is coupled to the memory 1019. The memory 1019 is coupled to a first input of the timing recovery logic 1014, a first input of the $(_{phi\text{-}1})$ correlation logic 1028 and a first input of the $(_{phi\text{-}2})$ correlation logic 1030.

The bandpass filter 1008 receives a PSK signal 1002. The switch 1010 receives a $T(_{phi\text{-}1})$ signal 1004 and a $T(_{phi\text{-}2})$ signal 1006. The $T(_{phi\text{-}1})$ signal 1004 and the $T(_{phi\text{-}2})$ signal 1006 are tails from a first data representation and a second data representation, respectively.

An output of the bandpass filter 1008 is coupled to a first input of the tail subtract logic 1012 and an input of the timing recovery logic 1014. An output of the switch 1010 is coupled as a second input of the tail subtract logic 1012.

A first output of the timing recovery logic 1014 is a timing signal for the first phase, which is a second input of the (phi-1) correlation logic 1028. A second output of the timing recovery logic 1014 is a timing signal for the second phase, which is a second input of the (phi-2) correlation logic 1030.

An output of the tail subtract logic 1012 is coupled to a third input of the (phi-1) correlation logic 1028 and to a third input of the (phi-2) correlation logic 1030. An output of the (phi-1) correlation logic 1028 is coupled to a first input of the detection logic 1034. An output of the (phi-2) correlation logic 1030 is coupled to a second input of the detection logic 1034. The output of the detection logic 1034 is an output signal 1036 of the PSK receiver 1000. The output signal 1036 is coupled to an input of the switch 1010.

Figure 11A:
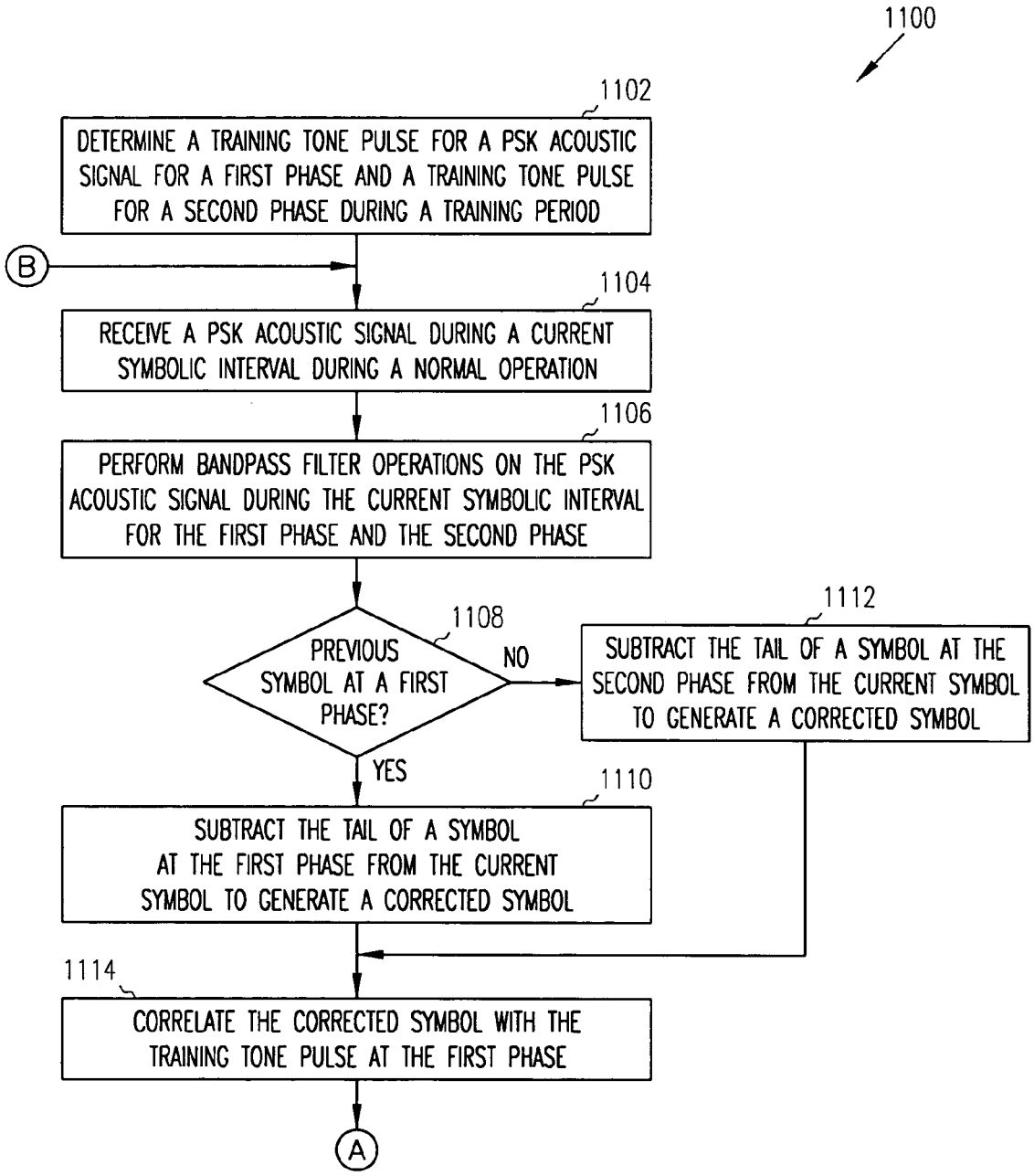
FIGS. 11A-11B illustrate a flow diagram for operations of a PSK receiver, according to some embodiments of the invention.
Figure 11B:
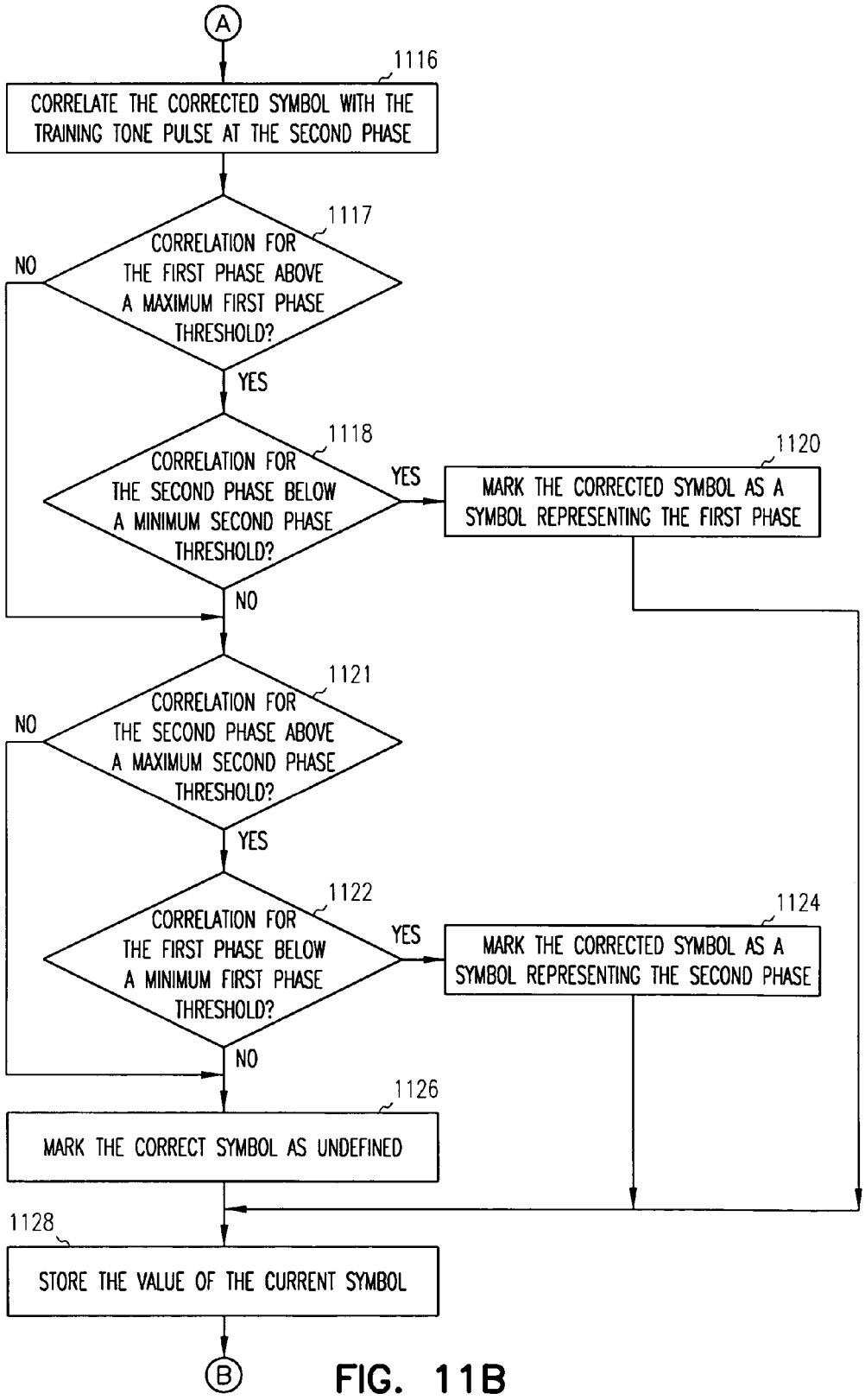

One embodiment of the operations of the PSK receiver 1000 is now described in more detail in conjunction with a flow diagram 1100 of FIGS. 11A-11B. In particular, FIGS. 11A-11B illustrate a flow diagram for operations of a PSK receiver, according to some embodiments of the invention.

In block 1102, a training tone pulse at a first phase and a training tone pulse at a second phase for a PSK signal during a training period are determined. With reference to the embodiment of FIG. 10, the training logic 1015 may make this determination. For binary signaling, the PSK signal 1002 may be a tone pulse over a symbolic interval at a first phase for data "one" and a tone pulse over a symbolic interval at a second (different) frequency for data "zero". In some embodiments, the first phase is shifted approximately 180 degrees relative to the second phase.

The training PSK signal 1001 may be a sequence of approximately identical widely spaced tone pulses at a first phase and a sequence of approximately identical widely spaced tone pulses at a second phase sent by the acoustic telemetry transmitter 123. In particular, the sequence of tone pulses at the first and second phases is widely spaced such that there is no interference between the pulses. The training logic 1015 may receive the training the PSK signal 1001 during an approximately noise free operating environment. The training logic 1015 may store these trained tone pulses into the memory 1019. As further described below, the $(_{phi\text{-}1})$ correlation logic 1028 and the $(_{phi\text{-}2})$ correlation logic 1030 may correlate these trained tone pulses with the acoustic signals received during normal drilling operations. Additionally, the timing recovery logic 1014 may determine the current symbolic interval for the first phase and the second phase during this training period (as described above). Control continues at block 1104.

In block 1104, a PSK signal is received during a current symbolic interval during normal operations. With reference to the embodiment of FIG. 10, the bandpass filter 1008 may receive the PSK signal 1002. The location of the current symbolic interval may be based on the timing of such interval (received from the timing recovery logic 1014). Control continues at block 1106.

In block 1106, bandpass filter operations are performed on the PSK signal in the current symbolic interval with regard to the first phase and the second phase. With reference to the embodiment of FIG. 10, the bandpass filter 1008 may perform these bandpass filter operations. Control continues at block 1108.

In block 1108, a determination is made of whether the previous symbol is at the first phase. With reference to the embodiment of FIG. 10, the switch 1010 may make this determination. As shown, the output signal from the detection logic 1034 is inputted into the switch 1010. This output signal is an indication of whether the symbol is a tone pulse at the first phase or a tone pulse at the second phase (representing a first value, such as a binary one, or a second value, such as a binary zero, respectively). Accordingly, the switch 1010 may make this determination based on the output from the previous symbolic interval.

In block 1110, upon determining that the previous symbol is at the first phase, the tail of a symbol at the first phase is subtracted from the symbol in the current symbolic interval to generate a corrected symbol for the current symbolic interval. With reference to the embodiment of FIG. 10, the tail subtract logic 1012 may perform this operation. The switch 1010 may input the $T(_{phi\text{-}1})$ signal 1004 (which is a tail at the first phase) into the tail subtract logic 1012 if the previous symbol is at the first phase. The tail subtract logic 1012 may subtract the $T(_{phi\text{-}1})$ signal 1004 from the symbol in the current symbolic interval. Control continues at block 1114, which is described in more detail below.

In block 1112, upon determining that the previous symbol is not at the first phase (rather the second phase), the tail of a symbol at the second phase is subtracted from the symbol in the current symbolic interval to generate a corrected symbol for the current symbolic interval. With reference to the embodiment of FIG. 10, the tail subtract logic 1012 may perform this operation. The switch 1010 may input the $T(_{phi\text{-}2})$ signal 1006 (which is a tail at the second phase) into the tail subtract logic 1010 if the previous symbol is at the second phase. The tail subtract logic 1012 may subtract the $T(_{phi\text{-}2})$ signal 1006 from the symbol in the current symbolic interval. Control continues at block 1114.

In block 1114, the corrected symbol is correlated with the training tone pulse at the first phase to generate a first correlated output. With reference to the embodiment of FIG. 10, the (phi-1) correlation logic 1028 correlates the corrected signal with the training tone pulse at the first phase. The (phi-1) correlation logic 1028 compares the corrected signal with the training tone pulse at the first phase to determine the correlation there between. Control continues at block 1116.

In block 1116, the corrected symbol is correlated with the training tone pulse at the second phase to generate a second correlated output. With reference to the embodiment of FIG. 10, the (phi-2) correlation logic 1030 correlates the corrected signal with the training tone pulse at the second phase. The (phi-2) correlation logic 1030 compares the corrected signal with the training tone pulse at the second phase to determine the correlation there between. Control continues at block 1118.

In block 1117, a determination is made of whether the correlation for the first phase (the first correlated output) is above a maximum first phase threshold. With reference to the embodiment of FIG. 10, the detection logic 1034 may make this determination. Upon determining that the correlation for the first phase is not above the maximum first phase threshold, control continues at block 1121, which is described in more detail below.

In block 1118, upon determining that the correlation for the first phase is above the maximum first phase threshold, a determination is made of whether the correlation for the second phase (the second correlated output) is below a minimum second phase threshold. With reference to the embodiment of FIG. 10, the detection logic 1034 may make this determination. Accordingly, in some embodiments, both correlation outputs (for the two different phases) may be analyzed in the determinations related to whether the corrected symbol is at the first phase (shown in blocks 1117/1118). However, embodiments of the invention are not so limited as either one of the correlations alone may be used in this determination. Upon determining that the correlation for the second phase is not below the minimum second phase threshold, control continues at block 1121, which is described in more detail below.

In block 1120, upon determining that the correlation for the second phase is not below the minimum second phase threshold, the corrected symbol is marked as a symbol representing the first phase. With reference to the embodiment of FIG. 10, the detection logic 1034 may mark the corrected symbol. Therefore, if the symbol for the first phase is defined as a binary one, the corrected symbol is marked as a binary one. Control continues at block 1128, which is described in more detail below.

In block 1121, upon determining that the correlation for the first phase is not above the maximum first phase threshold or that the correlation for the second phase is not below a minimum second phase threshold, a determination is made of whether the correlation for the second phase (the second correlated output) is above a maximum second phase threshold. With reference to the embodiment of FIG. 10, the detection logic 1034 may make this determination. Upon determining that the correlation for the first phase is not above the maximum first phase threshold, control continues at block 1126, which is described in more detail below.

In block 1122, upon determining that the correlation for the second phase is above a maximum second phase threshold, a determination is made of whether the correlation for the first phase (the first correlated output) is below a minimum first phase threshold. With reference to the embodiment of FIG. 10, the detection logic 1034 may make this determination. Accordingly, in some embodiments, both correlation outputs (for the two different phases) may be analyzed in the determinations related to whether the corrected symbol is at the second phase (shown in blocks 1121/1122). However, embodiments of the invention are not so limited as either one of the correlations alone may be used in this determination. Upon determining that the correlation for the first phase is not below the minimum first phase threshold, control continues at block 1126, which is described in more detail below.

In block 1124, upon determining that the correlation for the second phase is above the maximum second phase threshold and that the correlation for the first phase is below a minimum first phase threshold, the corrected symbol is marked as a symbol representing the second phase. With reference to the embodiment of FIG. 10, the detection logic 1034 may mark the corrected symbol. Therefore, if the symbol for the second phase is defined as a binary zero, the corrected symbol is marked as a binary zero. Control continues at block 1128, which is described in more detail below.

In block 1126, upon determining that the correlation for the second phase is not above the maximum second phase threshold or that the correlation for the first phase is not below a minimum first phase threshold, the corrected symbol is marked as undefined. With reference to the embodiment of FIG. 10, the detection logic 1034 may mark the corrected symbol. Therefore, if based on the correlation outputs and the thresholds the detection logic 1034 cannot determine whether the corrected symbol is a symbol representing either of the phases, the corrected symbol is set as undefined. For example, the correct symbol may be undefined because of an excessive amount of noise in the system. In some embodiments, if N number of corrected symbols are set as undefined in a predefined period, the PSK receiver 1000 may set an alarm and/or reboot and re-determine the training tone pulses for the first phase and the second phase. In some embodiments, if N number of corrected symbols are consecutively set as undefined, the PSK receiver 1000 may set an alarm and/or reboot and re-determine the training tone pulses for the first phase and the second phase. Control continues at block 1128.

In block 1128, the value of the corrected symbol is stored. With reference to the embodiment of FIG. 10, the detection logic 1034 may store this value into a memory (not shown) internal or external to the PSK receiver 1000. Such value may then be further processed to interpret the communications based on such symbols. Additionally, the detection logic 1034 may store this value into a memory within the switch 1010. Accordingly, for the subsequent symbolic interval, the switch 614 may input the $T(_{phi-1})$ signal 1004 and a $T(_{phi-2})$ signal 1006 depending on whether this symbol was at a first phase or a second phase, respectively (as described in blocks 1110 and 1112). Control continues at block 1104, where another PSK signal is received for the subsequent symbolic interval. In some embodiments, these different thresholds (e.g., the maximum first threshold, the maximum second threshold, the minimum first threshold and the minimum second threshold) are configurable values that may be set based on the environment of operation.

While the flow diagrams 700, 900 and 1100 illustrate the generation of the training pulses during an initial training period, such training may be subsequently re-executed. For example, the tails generated during training may be affected by different physical characteristics of the drill string (e.g., the length). In particular, after a given time of drilling operations, the drill string may be physically altered because of the stresses applied thereto during such operations. Additionally, the physical characteristics may be altered by the removal or addition of a section of drill pipe on the drill string. Accordingly, if a section of the drill string is removed or added, the training may be re-executed. The training may also be re-executed after a given time of drilling operations (e.g., 100 hours of operation).

Moreover, while described with reference to an OOK signal, a FSK signal and a PSK signal, embodiments of the invention are not so limited. Any of a number of different types of signaling can be used that allows for different symbols. For example, symbols may be different shaped envelopes, different levels and/or different chirp pulses that represent different values.

In the description, numerous specific details such as logic implementations, opcodes, means to specify operands, resource partitioning/sharing/duplication implementations, types and interrelationships of system components, and logic partitioning/integration choices are set forth in order to provide a more thorough understanding of the present invention. It will be appreciated, however, by one skilled in the art that embodiments of the invention may be practiced without such specific details. In other instances, control structures, gate level circuits and full software instruction sequences have not been shown in detail in order not to obscure the embodiments of the invention. Those of ordinary skill in the art, with the included descriptions will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Embodiments of the invention include features, methods or processes that may be embodied within machine-executable instructions provided by a machine-readable medium. A machine-readable medium includes any mechanism which provides (i.e., stores and/or transmits) information in a form accessible by a machine (e.g., a computer, a network device, a personal digital assistant, manufacturing tool, any device with a set of one or more processors, etc.). In an exemplary embodiment, a machine-readable medium includes volatile and/or non-volatile media (e.g., read only memory (ROM), random access memory (RAM), magnetic disk storage media, optical storage media, flash memory devices, etc.), as well as electrical, optical, acoustical or other form of propagated signals (e.g., carrier waves, infrared signals, digital signals, etc.).

Such instructions are utilized to cause a general or special purpose processor, programmed with the instructions, to perform methods or processes of the embodiments of the invention. Alternatively, the features or operations of embodiments of the invention are performed by specific hardware components which contain hard-wired logic for performing the operations, or by any combination of programmed data processing components and specific hardware components. Embodiments of the invention include software, data processing hardware, data processing system-implemented methods, and various processing operations, further described herein.

A number of figures show block diagrams of systems and apparatus for an acoustic telemetry receiver, in accordance with some embodiments of the invention. A number of figures show flow diagrams illustrating operations for an acoustic telemetry receiver, in accordance with some embodiments of the invention. The operations of the flow diagrams are described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

In view of the wide variety of permutations to the embodiments described herein, this detailed description is intended to be illustrative only, and should not be taken as limiting the scope of the invention. For example, embodiments of the invention are described in reference to correlations between two different values based on different attributes (phase, frequency, etc.). However, embodiments of the invention are not so limited. Embodiments of the invention may correlate among N number of different values based on a number of different attributes. For example, the pulses may be on multiple frequencies, multiple phases and/or multiple channels. Accordingly, these different pulses may have each have a training pulse for correlations during the acoustic telemetry operations. What is claimed as the invention, therefore, is all such modifications as may come within the scope and spirit of the following claims and equivalents thereto. Therefore, the specification and drawings are to be regarded in an illustrative rather than a restrictive sense.

What is claimed is:

1. A method comprising:

receiving an acoustic signal that is propagated along a drill string; and subtracting a tail of a first symbol in a first symbolic interval of the acoustic signal from a second symbol in a second symbolic interval of the acoustic signal to generate a corrected second symbol.

2. The method of claim 1, wherein receiving the acoustic signal that is propagated along the drill string comprises receiving a phase shift keyed acoustic signal that is propagated along the drill string.

3. The method of claim 1, wherein receiving the acoustic signal that is propagated along the drill string comprises receiving an on-off keyed acoustic signal that is propagated along the drill string.

4. The method of claim 1, wherein receiving the acoustic signal that is propagated along the drill string comprises receiving a frequency shift keyed acoustic signal that is propagated along the drill string.

5. The method of claim 1, further comprising performing a bandpass filter operation of the acoustic signal prior to the subtracting of the tail.

6. The method of claim 1, further comprising correlating the corrected second symbol to an approximately noise free acoustic signal propagated along the drill string that is representative of a first value.

7. The method of claim 6, further comprising determining at least one representation of the approximately noise free acoustic signal representative of the first value during a training period.

8. The method of claim 6, further comprising correlating the corrected symbol to an approximately noise free acoustic signal propagated along the drill string that is representative of a second value.

9. The method of claim 8, further comprising generating at least one representation of the approximately noise free acoustic signal representative of the second value during the training period.

10. An apparatus comprising:

a tail subtract logic to receive an acoustic signal that is propagated along a drill pipe, wherein the tail subtract logic is to subtract a tail of a first symbol in a first symbolic interval of the acoustic signal from a second symbol in a second symbolic interval of the acoustic signal to generate a corrected second symbol.

11. The apparatus of claim 10, wherein the tail subtract logic is to receive the acoustic signal during a drilling operation.

12. The apparatus of claim 10, wherein the tail subtract logic is to receive the acoustic signal during a drill stem test operation.

13. The apparatus of claim 10, further comprising a timing recovery logic to locate the first symbolic interval and the second symbolic interval.

14. The apparatus of claim 13, wherein the timing recovery logic includes an early-late-gate correlation timing circuit.

15. The apparatus of claim 10, further comprising a training logic to determine a representation of a symbol in an approximately noise free acoustic signal during a training period.

16. The apparatus of claim 15, further comprising a correlation logic to correlate the corrected second symbol with the representation of the symbol in the approximately noise free acoustic signal.

17. The apparatus of claim 16, further comprising a detection logic to determine whether the corrected second symbol is the representation of the symbol in the approximately noise free acoustic signal based on a threshold.

18. A method comprising:

receiving an on off key (OOK) acoustic signal that is propagated along a drill pipe during a current symbolic interval;

subtracting a tail of a previous symbol in a previous symbolic interval of the OOK acoustic signal that is carried over into the current symbolic interval from a current symbol in the current symbolic interval of the OOK acoustic signal to generate a corrected current symbol; and correlating the corrected current symbol to a training tone pulse of the OOK acoustic signal generated in an approximately noise free environment that propagated along the drill pipe.

19. The method of claim 18, further comprising receiving, along the drill pipe, the training tone pulse during a training period that does not include intersymbol interference to generate the training tone pulse of the acoustic signal generated in the approximately noise free environment.

20. The method of claim 18, further comprising performing a bandpass filter of the OOK acoustic signal during the current symbolic interval prior to subtracting the tail of the previous symbol in the previous symbolic interval of the OOK acoustic signal.

21. The method of claim 18, further comprising determining whether the corrected current symbol is approximately equal to the training tone pulse based on a threshold.

22. The method of claim 21, wherein correlating the corrected current symbol to the training tone pulse of the OOK acoustic signal comprises multiplying the corrected current symbol by the training tone pulse to generate a multiplied output.

23. The method of claim 22, wherein determining whether the corrected current symbol is approximately equal to the training tone pulse based on the threshold comprises determining whether the multiplied output is greater than the threshold.

24. An acoustic telemetry receiver comprising:

a training logic to determine a representation of a training tone pulse in an on off key (OOK) acoustic signal that is propagated along a drill pipe during a training period in an approximately noise free environment;

a tail subtract logic to receive a current symbol in a current symbolic interval within the OOK acoustic signal during a non-training period, wherein the tail subtract logic is to subtract a tail of a previous symbol in a previous symbolic interval of the OOK acoustic signal from the current symbol to generate a corrected current symbol; and a correlation logic to correlate the corrected current symbol to the training tone pulse.

25. The acoustic telemetry receiver of claim 24, wherein the tail subtract logic is to receive the current symbol in the current symbolic interval during a drill stem test operation.

26. The acoustic telemetry receiver of claim 24, wherein the tail subtract logic is to receive the current symbol in the current symbolic interval during a drilling operation.

27. The acoustic telemetry receiver of claim 24, further comprising a detection logic to mark the corrected current symbol as a tone pulse type if the correlation is above a threshold, the detection logic to mark the corrected current symbol as a non-tone pulse type if the correlation is below a threshold.

28. The acoustic telemetry receiver of claim 24, further comprising a timing recovery logic to locate the previous symbolic interval and the current symbolic interval.

29. The acoustic telemetry receiver of claim 24, wherein the correlation logic is to correlate the corrected current symbol to the training tone pulse based on a multiplication of the corrected current symbol with the training tone pulse.

30. The acoustic telemetry receiver of claim 29, further comprising a detection logic to mark the corrected current symbol as a tone pulse type if a value of the multiplication is greater than a threshold.

31. The acoustic telemetry receiver of claim 29, wherein the timing recovery logic includes an early-late-gate correlation timing circuit.

32. A machine-readable medium that provides instructions, which when executed by a machine, cause said machine to perform operations comprising:

receiving an on off key (OOK) acoustic signal that is propagated along a drill pipe during a current symbolic interval;

subtracting a tail of a previous symbol in a previous symbolic interval of the OOK acoustic signal that is carried over into the current symbolic interval from a current symbol in the current symbolic interval of the OOK acoustic signal to generate a corrected current symbol; and correlating the corrected current symbol to a training tone pulse of the OOK acoustic signal generated in an approximately noise free environment that propagated along the drill pipe.

33. The machine-readable medium of claim 32, further comprising receiving, along the drill pipe, the training tone pulse during a training period that does not include intersymbol interference to generate the training tone pulse of the acoustic signal generated in the approximately noise free environment.

34. The machine-readable medium of claim 32, further comprising performing a bandpass filter of the OOK acoustic signal during the current symbolic interval prior to subtracting the tail of the previous symbol in the previous symbolic interval of the OOK acoustic signal.

35. The machine-readable medium of claim 32, further comprising determining whether the corrected current symbol is approximately equal to the training tone pulse based on a threshold.

36. The machine-readable medium of claim 35, wherein correlating the corrected current symbol to the training tone pulse of the OOK acoustic signal comprises multiplying the corrected current symbol by the training tone pulse to generate a multiplied output.

37. The machine-readable medium of claim 36, wherein determining whether the corrected current symbol is approximately equal to the training tone pulse based on the threshold comprises determining whether the multiplied output is greater than the threshold.

38. A system comprising:

an acoustic telemetry receiver coupled to receive an acoustic signal that is propagated along a drill string, wherein the acoustic telemetry receiver comprises a tail subtract logic to subtract a tail of a first symbol in a first symbolic interval of the acoustic signal from a second symbol in a second symbolic interval of the acoustic signal to generate a corrected second symbol.

39. The system of claim 38, wherein the acoustic telemetry receiver is to receive the acoustic signal during a drilling operation.

40. The system of claim 38, wherein the acoustic telemetry receiver is to receive the acoustic signal during a drill stem test operation.

41. The system of claim 38, wherein the acoustic telemetry receiver is positioned approximately at or above the surface of the Earth.

42. The system of claim 38, wherein the acoustic telemetry receiver comprises a timing recovery logic to locate the first symbolic interval and the second symbolic interval.

43. The system of claim 42, wherein the timing recovery logic includes an early-late-gate correlation timing circuit.

44. The system of claim 38, wherein the acoustic telemetry receiver comprises a training logic to determine a representation of a symbol in an approximately noise free acoustic signal during a training period.

45. The system of claim 44, wherein the acoustic telemetry receiver comprises a correlation logic to correlate the corrected second symbol with the representation of the symbol in the approximately noise free acoustic signal.

46. The system of claim 45, wherein the acoustic telemetry receiver comprises a detection logic to determine whether the corrected second symbol is the representation of the symbol in the approximately noise free acoustic signal based on a threshold.

* * * * *